US007416696B2

(12) United States Patent
Kosco

(10) Patent No.: US 7,416,696 B2
(45) Date of Patent: Aug. 26, 2008

(54) POWDER METAL MATERIALS AND PARTS AND METHODS OF MAKING THE SAME

(75) Inventor: John C. Kosco, St. Marys, PA (US)

(73) Assignee: Keystone Investment Corporation, Wilmington, DE (US)

( * ) Notice: Subject to any disclaimer, the term of this patent is extended or adjusted under 35 U.S.C. 154(b) by 229 days.

(21) Appl. No.: 10/767,014

(22) Filed: Jan. 29, 2004

(65) Prior Publication Data

US 2004/0177719 A1 Sep. 16, 2004

Related U.S. Application Data

(60) Provisional application No. 60/508,575, filed on Oct. 3, 2003.

(51) Int. Cl.
*B22F 3/24* (2006.01)

(52) U.S. Cl. ..... 419/28

(58) Field of Classification Search ..... 419/28
See application file for complete search history.

(56) References Cited

U.S. PATENT DOCUMENTS

| | | | | |
|---|---|---|---|---|
| 3,874,049 | A | 4/1975 | Ferguson | |
| 4,059,879 | A | 11/1977 | Chmura et al. | |
| 4,121,927 | A * | 10/1978 | Lohman et al. | 419/14 |
| 4,277,544 | A | 7/1981 | Pietrocini | |
| 4,708,912 | A | 11/1987 | Huppmann | |
| 5,009,842 | A | 4/1991 | Hendrickson et al. | |
| 5,512,236 | A | 4/1996 | Jones et al. | |
| 5,540,883 | A | 7/1996 | Jones et al. | |
| 5,613,180 | A | 3/1997 | Kosco | |
| 5,711,187 | A | 1/1998 | Cole et al. | |
| 5,729,822 | A | 3/1998 | Shivanath et al. | |
| 5,972,132 | A | 10/1999 | Cadle | |
| 6,013,225 | A | 1/2000 | Cadle et al. | |

(Continued)

FOREIGN PATENT DOCUMENTS

GB 1532641 11/1978

(Continued)

OTHER PUBLICATIONS

Mogul, J. and Diepart, C.P, "Process Controls the Key to Reliability of Shot Peening," *Industrial Heating*, Nov. 1995 pp. 34-35.

*Primary Examiner*—George Wyszomierski
(74) *Attorney, Agent, or Firm*—K&L Gates LLP

(57) ABSTRACT

Embodiments of the present invention relate to methods of forming powder metals materials and parts. More specifically, certain embodiments of the present invention relate to methods of forming powder metals materials and parts by densifying at least a portion of a surface of the materials and/or parts after sintering and prior to densifying one or more core regions of the materials and/or parts. Other embodiment provide powder metal parts, such as gears and sprockets, having surface regions that are uniformly densified to full density to depth ranging from 0.001 inches to 0.040 inches, and core regions that can have at least 92 percent theoretical density and further can have essentially full density, or full density. Still other embodiments relate to brazed, welded, plated and gas-tight powder metal parts and components that can be made in accordance with the various non-limiting methods disclosed herein.

42 Claims, 3 Drawing Sheets

U.S. PATENT DOCUMENTS

| | | | |
|---|---|---|---|
| 6,017,489 | A | 1/2000 | Woolf et al. |
| 6,171,546 | B1 | 1/2001 | Mars et al. |
| 6,338,747 | B1 | 1/2002 | Kosco |
| 6,473,964 | B1 | 11/2002 | Anderson et al. |
| 6,485,540 | B1 | 11/2002 | Kosco |
| 6,592,809 | B1 | 7/2003 | Anderson et al. |
| 6,630,101 | B2 | 10/2003 | Anderson et al. |
| 2003/0155041 | A1 | 8/2003 | Bengtsson et al. |

FOREIGN PATENT DOCUMENTS

| | | | |
|---|---|---|---|
| GB | 2250227 | A | 6/1992 |
| JP | 61-261402 | | 11/1986 |
| JP | 61-264101 | | 11/1986 |
| JP | 02-138554 | | 5/1990 |
| JP | 07-100629 | | 4/1995 |
| SE | 435026 | | 9/1984 |
| WO | WO-92/05897 | A1 | 4/1992 |
| WO | WO-94/14557 | | 7/1994 |

* cited by examiner

POWDER METAL MATERIALS AND PARTS AND METHODS OF MAKING THE SAME

CROSS-REFERENCE TO RELATED APPLICATIONS

This application claims benefit of provisional application Ser. No. 60/508,575, filed Oct. 3, 2003.

STATEMENT REGARDING FEDERALLY SPONSORED RESEARCH OR DEVELOPMENT

Not applicable.

REFERENCE TO A SEQUENCE LISTING

Not applicable.

BACKGROUND

Embodiments of the present invention relate to methods of forming powder metal materials and powder metal parts. More specifically, certain embodiments of the present invention relate to methods of forming powder metal materials and/or powder metal parts by densifying one or more surface regions of the materials and/or parts after sintering and prior to densifying one or more core regions of the materials and/or parts. Other embodiments provide powder metal parts, such as gears and sprockets, having surface regions and core regions having essentially full density. Still other embodiments related to brazed, welded, plated and gas-tight powder metal parts and components that can be made in accordance with the various non-limiting methods disclosed herein.

The mechanical properties of powder metal ("P/M") materials tend to increase with increasing density. That is, as the density of a P/M material approaches the full or theoretical density of the material, the properties of the P/M material will approach those of the wrought material. As used herein, the term "theoretical density" means the true density of a material (or a part made therefrom) when fully densified into a product with no pores. Thus, as used herein, phrases "theoretical density of a powder metal material" or "theoretical density of a powder metal part" means the true density of the powder metal material (or part) when the material or part is fully densified into a product without any pores.

Conventional structural P/M materials made from iron-base alloys using single-press and sinter P/M forming processes typically yield P/M materials having densities ranging from 6.8 grams per cubic centimeter ("g/cc") to 7.2 g/cc, depending upon the alloy. However, these densities are generally only about 86 to 92 percent of the theoretical density of the material.

Processes that have been used to increase the density of P/M materials and parts include, for example: double press and double sinter processes ("DP/DS"); high fatigue alloy processes ("HFA"), which are described in detail in U.S. Pat. No. 5,613,180, which is hereby specifically incorporated by reference herein; and powder forging processes ("P/F"). Examples of typical densities that can be achieved for P/M materials or parts made from iron-base alloys using one of the aforementioned processes are given below in Table I:

TABLE I

| PROCESS | TYPICAL CORE DENSITIES (g/cc) | PERCENT THEORETICAL DENSITY |
|---|---|---|
| DP/DS | 7.3-7.5 | 92.8-95.3% |
| HFA | 7.45-7.65 | 94.6-97.2% |
| P/F | 7.7-7.85 | 97.8-99.9% |

While PM materials and/or parts produced via conventional DP/DS and HFA processes generally have the densities indicated in Table 1 in both the surface and the core regions of the part, PM materials and/or parts produced via conventional P/F processes generally have a slightly lower density in the surface regions of the part than in the core regions of the part. That is, core regions of conventionally powder forged P/M parts typically range from 97.8 to 99.9 percent of the theoretical density (or "percent theoretical density"), whereas surfaces typically have densities ranging from 97.8 to 99.0 percent theoretical density. As used herein, the term "core" or "core regions" means regions of the material or part interior to the surface. As used herein, the term "surface" means of the region of the material or part extending from an exterior of the material or part inwardly to a depth of about 0.040 inches. Further the term exterior refers to any externally disposed region of the material or part regardless of geometry. Thus, for example, the exterior of a tubular part includes the exterior defined by the outer wall of the tube, the exterior defined by the inner wall of the tube, and the exterior portions defined by the ends of the tube. As used herein, the term "depth" refers to the distance measured inwardly from an exterior of the part or material.

More particularly, in conventional P/F processing, a P/M part (or blank) that has been heated to around 1800° F. is placed into a forging die held at about 600° F. such that at least a portion of the surface of the part contacts the die surface during forging. Since the die is cooler than the part, the portions of the surface region of the part that are in contact with the die cool and becomes less formable than the interior of the part. As a result, forging does not increase the density of these surface portions to the same degree as the core regions of the part. Accordingly, these surface portions of the part typically exhibit more porosity than the core regions. This porosity is undesirable in certain applications as it creates areas of stress concentration during fatigue, which can result in premature fatigue failure.

One process that can increase the surface density of P/M materials and parts is surface rolling. In this method, a master, which has the desired final shape, is forced under pressure against a P/M part (or blank) which has been previously processed to a density of about 6.8 to 7.5 g/cc. Since the part is both lower in density and softer than the master, on contact with the master, the part can be conformed to the geometry of the master. At the points of contact with the master, the surface of the part can be densified to essentially full density or full density. As used herein, the terms "essentially full density" and "essentially fully dense" mean at least 98 percent of the theoretical density of the material (or part). As used herein the terms "full density" and "fully dense" mean greater than 99 percent of the theoretical density of the material (or part).

However, while the portion of the surface of a cylindrical part that is subjected to surface rolling can generally be uniformly densified to essentially full density (or full density) to depth ranging from to 0.010 inches to 0.020 inches, when parts having irregular surface geometries are subjected to surface rolling, the depth to which essentially full density (or full density) can be achieved can vary significantly within the densified portion of the surface. As used herein, the term "uniformly densified" means that at least 90% of the portion of the surface of a material or part that is subjected to densification is densified to the specified density and to the specified depth.

For example, when portions of the surface in the tooth root and/or flank regions of a gear are subjected to surface rolling, while some portions of the surface subjected to rolling can be densified to essentially full density (or full density) to a depth ranging from 0.010 inches to 0.020 inches, other substantial portions of the surface subjected to rolling can remain essentially undensified or achieve essentially full density (or full density) to a depth of less than 0.001 inches. In other words, the rolled surface is not uniformly densified to essentially full density (or full density) to a depth ranging from 0.010 to 0.020 inches. Accordingly, it can be difficult to attain sufficient depth and uniformity of densification by surface rolling when the part to be densified has irregularly shaped surfaces. Therefore, although surface rolling can be used to uniformly densify the surface of cylindrical P/M materials and parts, this method is less effective on irregularly shaped surfaces such as gear teeth, sprockets, and cams.

Further, although surface rolling as described above can increase the surface density of pressed and sintered P/M materials and parts, typically, the density of core regions of the P/M materials and parts remains the same as it was before rolling—i.e., 6.8 to 7.5 g/cc. While it is possible to densify one or more core regions of the PM materials and parts using one of the aforementioned processes (for example DP/DS, HFA, or P/F) prior to surface rolling one or more surface regions of the part, because the P/M material is relatively "hard" after these processes, surface rolling is generally not as effective in increasing the density of the surface of the part after these processes as immediately after sintering.

Additionally, while surface densification of P/M materials or parts, for example by surface rolling or shot peening, prior to sintering can have the effect of increasing the density of the surface of the materials or parts prior to further processing (such as by DP/DS, etc.), because the mechanical properties of the P/M materials or parts in the green state (i.e., unsintered state) are relatively low, surface densification prior to sintering is not practical for many applications. More specifically, subjecting a green P/M part to a surface densification process can result in cracking, breakage, or roughening of the part. This is particular true for parts having irregular features or small cross-sections, for example teeth or splines, which can be easily damaged during handling in the green state.

BRIEF SUMMARY

Certain non-limiting embodiments of the disclosure relate to methods of forming powder metal materials or powder metal parts. For example, one non-limiting embodiment provides a method of forming a powder metal material comprising molding a powder metal composition into a compact, sintering the compact, at least one of peening and surface rolling at least a portion of a surface of the compact after sintering to densify the at least a portion of the surface, and sizing the compact after shot peening to densify at least a portion of a core region of the compact.

Another non-limiting embodiment provides a method of forming a powder metal material comprising molding a powder metal composition into a compact, sintering the compact, at least one of peening and surface rolling at least a portion of a surface of the compact after sintering to densify the at least a portion of the surface, and forging the compact to densify at least a portion of a core region of the compact.

Another non-limiting embodiment provides a method of forming an iron-base powder metal part chosen from a gear and a sprocket, the method comprising molding a powder metal composition into a green part comprising at least one tooth having a root region and a flank region; sintering the green part; and subsequent to sintering the green part, shot peening at least a portion of an as-sintered surface in at least one of the tooth root region and the tooth flank region to uniformly densify the at least a portion of the as-sintered surface to a density of at least 98 percent of a theoretical density of the iron-base metal part to a depth of at least 0.001.

Still another non-limiting embodiment provides a method of forming a powder metal part comprising molding a powder composition into a green part comprising at least one tooth having a root region and a flank region; sintering the green part; subsequent to sintering the green part, shot peening at least a portion of a surface in at least one of the tooth root region and the tooth flank region to densify the at least a portion of the surface; and sizing the part after shot peening to densify at least a portion of a core region of the part.

Yet another non-limiting embodiment provides a method of forming a powder metal part comprising molding a powder metal composition into a part comprising at least one tooth having a root region and a flank region; sintering the green part; subsequent to sintering the green part, shot peening at least a portion of a surface in at least one of the tooth root region and the tooth flank region to densify the at least a portion of the surface; and forging the part to densify at least a portion of a core region of the part.

Still another non-limiting embodiment provides a method of forming a gear comprising molding a powder metal composition into a gear-shaped compact, the gear-shaped compact comprising at least one tooth having a root region and a flank region; sintering the gear-shaped compact; subsequent to sintering the gear-shaped compact, shot peening at least a portion of a surface in at least one of the tooth root region and the tooth flank region to densify the at least a portion of the surface; and at least one of sizing the gear-shaped compact and forging the gear-shaped compact after shot peening to densify at least a portion of a core region of the gear-shaped compact.

Other non-limiting embodiments disclosed herein relate to powder metal materials and parts. For example, one non-limiting embodiment provides a powder metal part made by molding a powder metal composition into a green powder metal part; sintering the green powder metal part; subsequent to sintering the green powder metal part, shot peening at least a portion of a surface of the sintered powder metal part to densify the at least a portion of the surface such that immediately after shot peening, the at least a portion of the surface has full density to a depth of at least 0.001 inches; and forging the powder metal part to densify at least a portion of a core region of the powder metal part; wherein after forging, the at least a portion of the at least one surface of the powder metal part that was shot peened is essentially free of finger oxides and the at least a portion of the core region of the part has a density of at least 98 percent of a theoretical density of the powder metal part.

Another non-limiting embodiment provides an iron-base powder metal part comprising a surface and a core, wherein both the surface and the core of the iron-base powder metal part have full density.

Still another non-limiting embodiment provides an iron-base powder metal part comprising at least one tooth having a root region and a flank region, wherein at least a portion of a surface in at least one of the tooth root region and the tooth flank region is uniformly densified to full density to a depth of at least 0.002 inches, and at least a portion of a core region of the iron-base powder metal part has a density of at least 92 percent of the theoretical density of the iron-base powder metal part.

Other non-limiting embodiments disclosed herein provide components and methods of forming components. For example, one non-limiting embodiment provides a method of forming a component comprising: (i) providing a powder metal part comprising a surface and a core region, wherein at least a portion of the surface of the powder metal part is uniformly densified to full density to a depth of at least 0.001 inches, and at least a portion of the core region of the powder metal part has a density of at least 92 percent of the theoretical density of the powder metal part; and (ii) joining at least a portion of the surface of the powder metal part that was uniformly densified to full density to a depth of at least 0.001 inches to at least a portion of at least one additional metal part by at least one of welding and brazing.

Another non-limiting embodiment provides a component comprising a powder metal part comprising a surface and a core region, wherein at least a portion of the surface of the powder metal part is uniformly densified to full density to a depth of at least 0.001 inches, and at least a portion of the core region of the powder metal part has a density of at least 92 percent of the theoretical density of the powder metal part; and at least one additional part joined to at least a portion of the powder metal part by at least one of welding and brazing at least a portion of the at least one additional part to the at least a portion of the surface of the powder metal part that was uniformly densified to full density to a depth of at least 0.001 inches.

Another non-limiting embodiment disclosed herein provides a powder metal part comprising a densified surface that is gas-tight, wherein the densified surface is uniformly densified to full density to a depth of at least 0.001 inches.

Another non-limiting embodiment disclosed herein provides a method of forming a powder metal part comprising forming a powder metal composition into a compact, sintering the compact, and shot peening at least a portion of an as-sintered surface of the compact such that immediately after shot peening, the at least a portion of the as-sintered surface is uniformly densified to full density to a depth of at least 0.001 inches and is gas-tight.

Another non-limiting embodiment disclosed herein provides a powder metal part comprising a plated surface that is essentially free of sealing materials, wherein the plated surface is uniformly densified to full density to a depth of at least 0.001 inches.

Still another non-limiting embodiment disclosed herein provides a method of forming a plated, powder metal part that is essentially free of sealing materials comprising forming a powder metal composition into a compact; sintering the compact; shot peening at least a portion of an as-sintered surface of the sintered compact such that immediately after shot peening, the at least a portion of the surface of the as-sintered sintered compact is uniformly densified to full density to a depth of at least 0.001 inches; and plating at least a portion of the surface that is uniformly densified.

BRIEF DESCRIPTION OF THE SEVERAL VIEWS OF THE DRAWING(S)

Embodiments of the present invention will be better understood when read in conjunction with the drawings in which.

DETAILED DESCRIPTION

Figure 1:
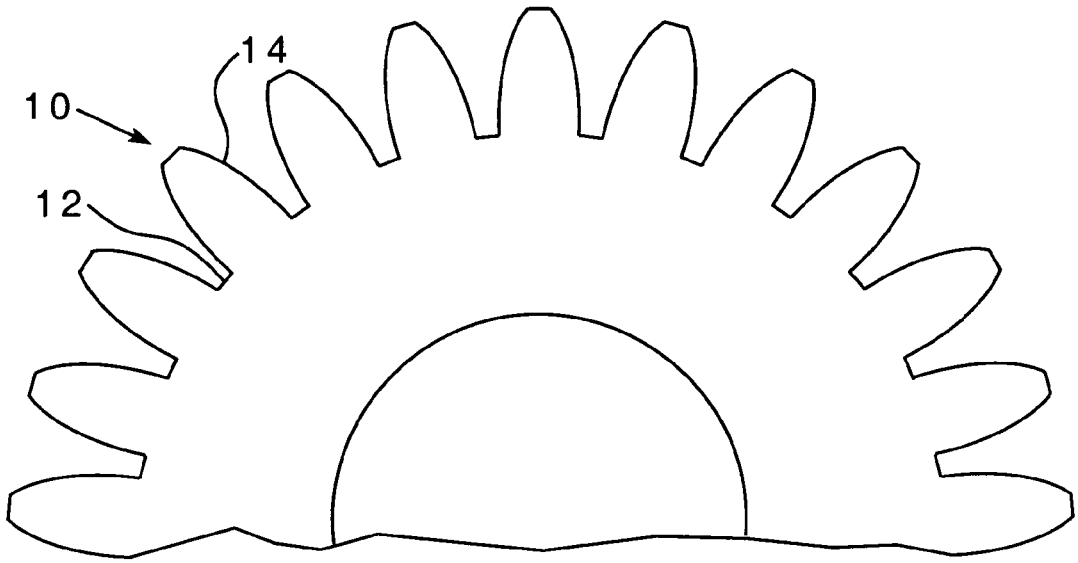
FIG. 1 is a schematic representation of the root region and the flank region of a tooth of a powder metal part.

Methods according to embodiments of the present invention can be advantageous for forming P/M materials and parts having either regularly shaped or irregularly shapes surfaces to achieve essentially full density, or full density, in at least a portion of a surface of the materials and/or parts, as well as to achieve densities in at least a portion of the core region of the materials and/or parts of at least 92% of the theoretical density of the material. As previously discussed, as used herein, the term "essentially full density" means at least 98 percent of the theoretical density of the material (or part). Further, as used herein the term "full density" means greater than 99 percent of the theoretical density of the material (or part). According to other embodiments of the present invention, there is provided a method of forming P/M materials and parts having regularly shaped surfaces, irregularly shaped surfaces, or a combination thereof to achieve essentially full density, or full density, in at least a portion of a surface of the material or part, as well as in at least a portion of the core region of the material or part.

The methods according to various non-limiting embodiments of the present invention will now be described. In one non-limiting embodiment there is provided a method of forming a P/M material comprising molding a powder metal composition into a compact. As used herein, the term "powder metal composition" means a composition comprising at least one powder metal.

Suitable powder metals for use in conjunction with the non-limiting embodiments disclosed herein include, but are not limited to, iron-base powder metals. As used herein, the term "iron-base powder metals" means powder metals formed from or containing iron or iron alloys. Non-limiting examples of suitable iron alloy powders include iron alloy powders with sintered carbon levels ranging from about 0.02 weight percent to about 0.8 weight percent. As used herein the term "sintered carbon level" means the amount of carbon present after sintering the powder metal. In one non-limiting embodiment, the powder metal is an iron alloy powder having a sintered carbon level ranging from about 0.02 weight percent to about 0.6 weight percent. In another non-limiting embodiment, the powder metal is an iron alloy powder having a sintered carbon level ranging from about 0.02 to about 0.4 weight percent. In another non-limiting embodiment, the powder metal is an iron alloy powder having a sintered carbon level ranging from about 0.6 weight percent to about 0.8 weight percent.

Specific, non-limiting examples of iron powders that are believed to be useful in various non-limiting embodiments disclosed herein include QMP ATOMET 1001 iron powder (which is commercially available from Quebec Metal Powders of Tracy, Quebec); Hoeganaes 1000 iron powder and Hoeganaes 1000B iron powder (which are commercially available from Hoeganaes Corporation of Riverton, N.J.); NAH ASC iron powder and AHC iron powder (which are commercially available from North American Hoganas of Hollsopple, Pa.); and Kobelco 300MA iron powder and 500MA iron powder (which are commercially available from Kobelco Metal Powder of America, Inc. of Seymour, Ind.).

Non-limiting examples of iron alloy powders that are believed to be useful in various non-limiting embodiments of the present invention include alloy steel powders containing nickel and molybdenum, and may further include one or more other alloying elements such as, but not limited to, chromium and manganese. Specific, non-limiting examples of such iron alloy powders that are commercially available include QMP ATOMET 4401 alloy steel powder (containing 0.85% molybdenum, 0.05% nickel, 0.05% chromium, and 0.15% manganese), ATOMET 4201 alloy steel powder (containing 0.60% molybdenum, 0.45% nickel, 0.05% chromium, and 0.28% manganese), ATOMET 4701 alloy steel powder (containing 0.9% nickel, 1.0% molybdenum, 0.45% chromium, and 0.45% manganese) and ATOMET 4601 alloy steel powder (containing 1.8% nickel and 0.55% molybdenum, and 0.2% manganese); Hoeganaes 2000 alloy steel powder (containing nickel, molybdenum, and manganese), 4600V alloy steel powder (containing nickel, molybdenum, and manganese), 85HP alloy steel powder (containing 0.85% molybdenum) and 150HPan alloy steel powder (containing 1.5% molybdenum); and NAH ASTALOY A alloy steel powder (containing 0.55% molybdenum, 1.85% nickel, and 0.2% manganese) and ASTALOY B an alloy steel powder (containing nickel and molybdenum). Other specific, non-limiting examples of commercially available iron alloy powders containing chromium include NAH ASTALOY CrL alloy powders and ASTALOY CrM alloy powders.

For example, although not limiting herein, according to one embodiment of the invention the powder metal comprises iron and at least one alloying element chosen from nickel, molybdenum, chromium, manganese, copper, and phosphorus.

Additionally, although not limiting herein, the powder metal compositions according to various non-limiting embodiments disclosed herein can further comprise processing aids, such as lubricants and binders, and sintering aids. Further, the powder metal compositions can comprise reinforcement materials, such as fibers and/or particulate oxides, carbides, and nitrides.

Suitable methods of molding the powder metal composition into a compact include, but are not limited to, pressing the powder metal composition in a single action or multi-action die. Although not limiting herein, for iron-base alloys, typical compaction pressures range from about 30 tons per square inch ("tsi") to about 60 tsi, depending upon factors such as the alloy composition, the size and surface area of the powders themselves, the configuration of the part, and the desired green density of the part (i.e., the density of the compact after molding and prior to sintering).

For example, in one non-limiting embodiment, a powder metal composition comprising about 98 percent of a powder metal comprising iron and 2 weight percent nickel; about 0.7 weight percent graphite; and about 0.75 weight percent EBS (ethylene bis-stearamide) wax lubricant can be compacted in a mechanical or hydraulic press at a pressure ranging from 30 tsi to 60 tsi to form a compact having a green density of about 6.8 to 7.3 g/cc. However, as discussed above, higher or lower pressures may be employed depending upon such factors as the desired green density, the size and configuration of the compact, and the powder composition. For example, although not limiting herein, in certain non-limiting embodiments disclosed herein, wherein iron-base metal powders are employed, after compaction the material can have a green density ranging from about 6.5 g/cc to 7.3 g/cc.

According to the various non-limiting embodiments disclosed herein, after molding the powder metal composition into a compact, the compact is sintered. The sintering time, temperature, and atmosphere employed will depend upon factors such as the composition of the metal powder employed, the surface area of the powders, the size and configuration of the compact, as well as the desired properties of the sintered compact. Generally, the sintering time and temperature should be sufficient to permit adjacent powder surfaces to bond and to allow the material to develop certain mechanical properties, such as tensile strength and hardness, required in the final product or for further handling and processing. For example, although not limiting herein, when an iron-base metal powder composition is employed, sintering temperatures will typically range from about 2050° F. to about 2450° F. and the sintering atmosphere will typically be a non-oxidizing or a reducing atmosphere. More generally, according to various non-limiting embodiments disclosed herein, sintering can be conducted in a conventional manner known to those of ordinary skill in the art.

Although not required, if desired, according to the certain non-limiting embodiments, the compact can be pre-sintered prior to sintering. As used herein the term "pre-sinter" means to heat the metal powder compact to a temperature below the sintering temperature for a period of time to develop sufficient strength in the compact to permit further handling of the compact. As discussed above with respect to sintering, the time, temperature and atmosphere employed in the pre-sintering process will depend upon factors such as, but not limited to, the composition of the metal powder, the surface area of the powder, and the size and configuration of the compact. For example, although not limiting herein, if an iron-base metal powder is used, the pre-sintering temperature will typically range from about 1400° F. to about 1800° F. and the atmosphere will typically be a non-oxidizing or a reducing atmosphere. More generally, according to various non-limiting embodiments disclosed herein, pre-sintering can be conducted in a conventional manner known to those of ordinary skill in the art.

After sintering the compact, according to various non-limiting embodiments disclosed herein, at least a portion of at least one surface of the compact is densified to essentially full density. As used herein with reference to the surface, the term "portion" refers to any part of the surface, both in terms of depth and/or location. Although not required, the compact may be cooled after sintering and prior to surface densification. Further, if required to achieve a desired densification depth, according to certain non-limiting embodiments disclosed herein, at least a portion of the surface of the sintered compact may be decarburized prior to surface densification. In other non-limiting embodiments, the densified surface is an as-sintered surface. As used herein, the term "as-sintered" surface means a surface having essentially the same carbon content as the surface after sintering—i.e., a surface that has not been decarburized.

Methods of densifying at least a portion of at least one surface region of the P/M materials and/or parts according to the various non-limiting embodiments of the present invention include, but are not limited to peening and surface rolling. However, as previously discussed, while surface densification by surface rolling is possible, when complex or irregularly shaped surfaces are involved surface rolling may not provide adequate uniformity or depth of densification.

Thus, according to various non-limiting embodiments disclosed herein, wherein a complex or irregularly shaped surface is involved, surface densification can be accomplished by a means that is capable of uniformly densifying an irregularly shaped surface, such as peening.

Generally speaking, peening involves mechanically working the surface of the material by subjecting the surface to repeated impacts, during which the surface of the material is plastically deformed and densified. Although not limiting herein, most commonly, peening involves mechanically working the surface of the material by subjecting the surface to the repeated impact of small balls, or shot, i.e., "shot peening." However, other methods of peening, such as laser peening, can also be used in conjunction with various non-limiting embodiments disclosed herein.

According to various non-limiting embodiments disclosed herein, the shot peening parameters, for example, the size of the shot used (which is typically specified in terms of the diameter of the shot), the air pressure used to propel the shot, and the duration of the peening can be selected depending upon factors such as, but not limited to, the desired densification depth and the hardness of the material to be peened. Generally, as the diameter of the shot and the air pressure used to propel the shot increases, the depth of densification will also increase. See, for example, Serope Kalpakjian, *Manufacturing Processes for Engineering Materials*, Addison-Wesley Publishing Co., Reading, Mass. (1984) at pages 234-235, which are specifically incorporated by reference herein. Although not limiting herein, in certain non-limiting embodiments of the present invention the diameter of the shot used in the shot peening process typically ranges from about 0.005 inches to about 0.331 inches. in another non-limiting embodiment, shot peening the P/M material or part comprises impacting the material or part with shot having a diameter ranging from 0.016 inches to 0.046 inches. However, the size of the shot employed in the shot peening process can be larger than 0.331 inches or smaller than 0.005 inches as required to achieve the desired depth of densification.

The duration of shot peening can also be varied to achieve the desired depth of densification. In one non-limiting embodiment, the duration of the shot peening (or "shot time") ranges from 5 minutes to 45 minutes. However, shot times longer than 45 minutes or shorter than 5 minutes can be used in conjunction with various non-limiting embodiments of the present invention to achieve the desired depth of densification.

While the desired surface densification depth generally depends upon factors such as, but not limited to, the intended end-use of the P/M material or part being manufactured, according to one non-limiting embodiment, the at least a portion of the surface that is densified can be uniformly densified to essentially full density to a depth of at least 0.001 inches. As previously discussed, "uniformly densified" means that at least 90% of the portion of the surface of a material or part that is subjected to densification is densified to the specified density and to the specified depth. Thus, according to this non-limiting embodiment, after surface densification, at least 90% of the portion of the surface subjected to densification has essentially full density (i.e., at least 98 percent of the theoretical density of the material or part) to a depth of at least 0.001 inches.

In other non-limiting embodiments, the portion of the surface subjected to densification can be uniformly densified to essentially full density, or to full density, to a depth ranging from 0.001 inches to 0.040 inches. For example, in one non-limiting embodiment, the portion of the surface subjected to densification can be uniformly densified to essentially full density, or full density, to a depth of at least 0.002 inches. In another non-limiting embodiment, the portion of the surface subjected to densification can be uniformly densified to essentially full density, or full density, to a depth of at least 0.005. In still another non-limiting embodiment, the portion of the surface subjected to densification can be uniformly densified to a depth of at least 0.010. In yet another non-limiting embodiment the portion of the surface subjected to densification can be uniformly densified to a depth of at least 0.020 inches. In still other non-limiting embodiments, the portion of the surface subjected to densification can be uniformly densified to full density to a depth of at least 0.001 inches. For example, although not limiting herein, according to certain non-limiting embodiments, the densified portion of the surface can have a density ranging from 99.1 to 99.9 or 100 percent of the theoretical density of the material or part, or from 99.5 to 99.7 percent of the theoretical density of the material or part to a depth of at least 0.001 inches.

However, as discussed above, the desired densification depth will depend upon factors such as the intended use of the P/M material or part being manufactured. Accordingly, densification depths of less than 0.001 inches may be used in accordance with various non-limiting embodiments described herein. Further, in some non-limiting embodiments, the densification depth that results during surface densification can exceed 0.040 inches. That is, a portion of the core can be densified during the surface densification process.

Further, according to various non-limiting embodiments disclosed herein, after the at least a portion of the surface is densified, the densified surface portion can have essentially full density, or full density; whereas the undensified portions of the material (i.e., the core region and the portions of the surface that were not densified, if any) can retain essentially the same density that was achieved after compaction and sintering. For example, in one non-limiting embodiment wherein the metal powder is an iron-base metal powder, after surface densification, the portions of the surface that were densified can have a density ranging from about 7.7 g/cc (about 97.8% theoretical density) to about 7.85 g/cc (about 99.7% theoretical density) to a depth ranging from 0.001 inches to 0.040 inches, whereas the undensified core region and the portions of the surface that were not subjected to densification, if any, can have a density ranging from about 6.8 g/cc (about 86.4% theoretical density) to 7.3 g/cc (about 92.7% theoretical density).

In order increase the density of the undensified portions of the material, according to various non-limiting embodiments disclosed herein, after the surface densification process the material or part can be subjected to one or more secondary densification processes. Examples of suitable secondary densification processes include, but are not limited to, sizing and powder forging.

Sizing generally involves compacting a sintered P/M material or part at a pressure ranging from about 40 tsi to about 80 tsi to achieve a desired size or shape. For iron-base P/M materials and/or parts according to certain non-limiting embodiments disclosed herein, depending upon the initial density, hardness, and composition of the material or part, sizing can increase the density of the previously undensified core regions and/or surface portions of the P/M material and/or part by about 0.2 g/cc to about 0.55 g/cc. However, since the portions of the surface that were densified prior to sizing have essentially full density before sizing, generally sizing after surface densification will contribute little to the density of these already densified surface portions.

Another secondary densification process that is suitable for use in various embodiments of the present invention is powder forging. In powder forging, after sintering, if desired, the P/M material or part can be cooled (for example to room temperature), and subsequently reheated prior to forging. Alternately, the sintered part can be cooled to about 1800° F. and forged without reheating. Forging generally involves the plastic deformation of a metal into a desired shape and is usually performed hot, at high strain rates and may be done in constraining dies. For iron-base P/M materials and parts, depending upon the initial density, hardness, and composition of the material, powder forging can increase the density of the previously undensified core regions and/or surface portions of the material by about 0.60 g/cc to about 1.00 g/cc. However, again, since the portions of the surface that are densified prior to forging have essentially full density before forging, generally forging after surface densification will contribute little to the density of these densified surface portions.

Although not required, according to various non-limiting embodiments disclosed herein, after the second densification process, the P/M material or part can be further processed, such as by quench and tempering, or carburizing followed by quench and tempering, to increase the hardness of the material or part and optimize properties. Thereafter, if desired, the surface of the material or part can again be worked, for example by rolling, peening, or honing to introduce compressive stresses into the material. Other finishing processes known in the art, such as, but not limited to, lapping and polishing, can also be used in conjunction with various non-limiting embodiments of the present invention. Other secondary operations, such as, but not limited to, joining techniques such as, for example, welding and brazing can also be performed on the materials and parts after the secondary densification process.

According to another non-limiting embodiment there is provided a method of forming a P/M part comprising molding a powder metal composition into a green part having a desired configuration. In one non-limiting embodiment, the part comprises at least one irregularly shaped surface feature. For example, as show in FIG. 1, although not limiting herein, the part can comprise at least one tooth, generally indicated as 10, having a root region 12 and a flank region 14. Non-limiting examples of parts comprising at least one tooth having a root region and a flank region include gears and sprockets.

After molding the powder metal composition into the desired green part configuration, the green part is sintered as previously described. Subsequent to sintering the green part, at least a portion of a surface of the sintered part is densified by mechanically working the portion. As previously described, suitable methods of densifying the at least a portion of at least one surface region include, but are not limited to, surface rolling and peening. However, as previously discussed, the depth and uniformity that can be achieved by surface rolling irregularly shaped surface features, such as tooth roots and tooth flanks, is generally inadequate. Thus, according to one non-limiting embodiment, when the at least a portion of the surface to be densified is in the tooth root and/or tooth flank regions of the part, suitable surface densification can be achieved, for example, by a peening process.

Further, although not limiting herein, in certain non-limiting embodiments, wherein the portion of the surface to be densified includes both regularly shaped and irregularly shaped surface features (or regions), a combination of rolling and peening can be used to densify the portion of the surface. For example, the regularly shaped surface regions (for example flat or round regions) can be densified by surface rolling, and the irregularly shaped surface regions (for example the tooth root and tooth flanks regions) can be densified by peening. Alternatively, both the regularly and irregularly shaped surface regions can be densified by peening. For example, although not limiting herein, at least a portion of a surface in the tooth root and/or tooth flank regions of a P/M gear can be densified by peening, and at least a portion of a surface in the inner diameter region and/or on the faces of the gear can be densified by peening and/or surface rolling.

As discussed above, after densifying the at least a portion of the surface of the part, the densified portion can have essentially full density, or full density. However, the core and the portions of the surface that were densified, if any, will typically have a lower density than the densified surface portions, i.e., less than essentially full density. As previously discussed, in order increase the density of these lower density portions, according to certain non-limiting embodiments, after densifying at least a portion of at least one surface of the P/M part, the P/M part is then subjected to at least one secondary densification process. As discussed above, suitable secondary densification processes include, but are not limited to, sizing and powder forging.

According to various non-limiting embodiments, after the secondary densification process, the P/M part can have at least a portion of a surface that is uniformly densified to essentially full density, or full density, to at least 0.001 inches, and at least a portion of the core having a density of at least 92 percent of the theoretical density of the material or part. However, according to certain non-limiting embodiments of the present invention wherein the secondary densification process involves powder forging, the densified portion of the core can have essentially full density, or full density, after powder forging.

As previously described, although not required, according to certain non-limiting embodiments of the present invention, after the second densification process, the P/M material or part can be further processed, such as by quench and tempering, or carburizing followed by quench and tempering to increase the hardness of the material or part and optimize properties. Thereafter, if desired, the surface of the material or part can again be worked, for example by rolling, peening or honing, to introduce compressive stresses into the material. Other finishing processes known in the art, such as, but not limited to, lapping and polishing, can also be used in conjunction with various non-limiting embodiments of the present invention. Other secondary operations, such as, but not limited to, joining techniques such as, for example, welding and brazing can also be performed on the materials and parts after the secondary densification process.

The present invention further contemplates P/M materials and parts manufactured in accordance with the various non-limiting embodiments of the present invention. For example, in one non-limiting embodiment, there is provided a P/M part comprising a surface and a core region, wherein at least a portion of the surface of the P/M part is uniformly densified to full density to a depth of at least 0.001 inches and at least a portion of the core region of the P/M part has a density of at least 92 percent theoretical density of the P/M part. Further, according to this non-limiting embodiment, the P/M part can be a gear or a sprocket and can have a single tooth bend fatigue life of 3 million cycles at a load of 160 ksi. In still another non-limiting embodiment, there is provided a P/M part comprising a surface and a core region, wherein at least a portion of the surface of the P/M part is uniformly densified to full density to a depth of at least 0.001 inches and at least a portion of the core region of the P/M part has full density. Further, according to this non-limiting embodiment, the P/M part can be a gear or a sprocket and can have a single tooth bend fatigue life of 3 million cycles at a load of 190 ksi.

One non-limiting embodiment of the present invention provides an iron-base powder metal part comprising a surface and a core, wherein both the surface region and the core of the iron-base powder metal part have full density. For example, in non-limiting embodiment, the iron-base powder metal parts produced can have a surface and core region having a density of at least 7.8 g/cc. As previously discussed, although not limiting herein, powder metal parts having surfaces and core regions having full density can be achieved, for example, by molding and sintering a powder metal composition to form a part, shot peening the surface regions of the part, and thereafter forging the part.

In yet another non-limiting embodiment of the present invention there is provided an iron-base powder metal part comprising at least one tooth having a root region and a flank region, wherein at least a portion of a surface in at least one of the tooth root region and the tooth flank region is uniformly densified to full density to a depth of at least 0.001, and at least a portion of a core region of the iron-base powder metal part has a density of at least 92 percent of the theoretical density of the iron-base powder metal part. Further, according to this non-limiting embodiment, the at least a portion of the core region can have essentially full density or full density. Non-limiting methods of forming such iron-base powder metal parts are described above in detail.

In another non-limiting embodiment, there is provided a forged P/M part formed according to one non-limiting embodiment of the present invention having surfaces that are essentially free of finger oxides commonly found in conventionally powder forged iron-base P/M parts. That is, in conventional P/M forging processes, typically a low density compact is formed from a powder metal composition, sintered, and then placed in a reheat furnace prior to powder forging. Alternately, parts can be cooled from the sintering temperature to about 1800° F., then transferred to the forging press. However, during transfer from the reheat furnace, or sintering furnace, to the forging press the sintered compact is typically exposed to the air for about 2 to 10 seconds. As a result of this exposure during transfer, finger-shaped oxides (or "finger oxides") are frequently observed in and near the surface of the compact. Such oxides remain in the part after powder forging and are generally undesirable because they can act as notches that can serve as crack initiation sites and can lower the fatigue strength of the material.

Figure 2:
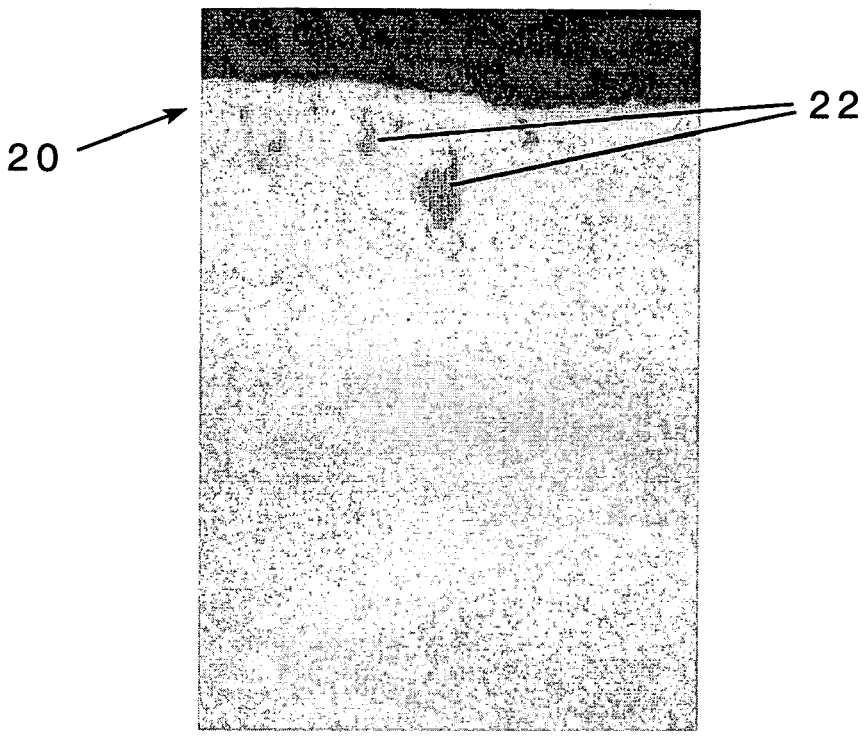
FIG. 2 is a micrograph showing surface oxides on the surface of a powder metal part formed by conventional powder forging.

Referring now to FIG. 2, there is shown a micrograph of a portion of a surface, generally indicated as 20, of a conventional powder forged, iron-base P/M part. As can be seen in FIG. 2, finger oxides 22 are present in the portion of the surface 20 of the conventionally powder forged P/M part.

Although not limiting herein, it has been observed by the inventor that when P/M materials and P/M parts are formed according to the various non-limiting embodiments of the present invention, the P/M materials and parts generally have little surface oxide formation. More specifically, the inventors have observed that when one or more surface regions are densified after sintering and prior to powder forging, for example by shot peening, the formation of such finger oxides can be reduced or eliminated.

Figure 3:
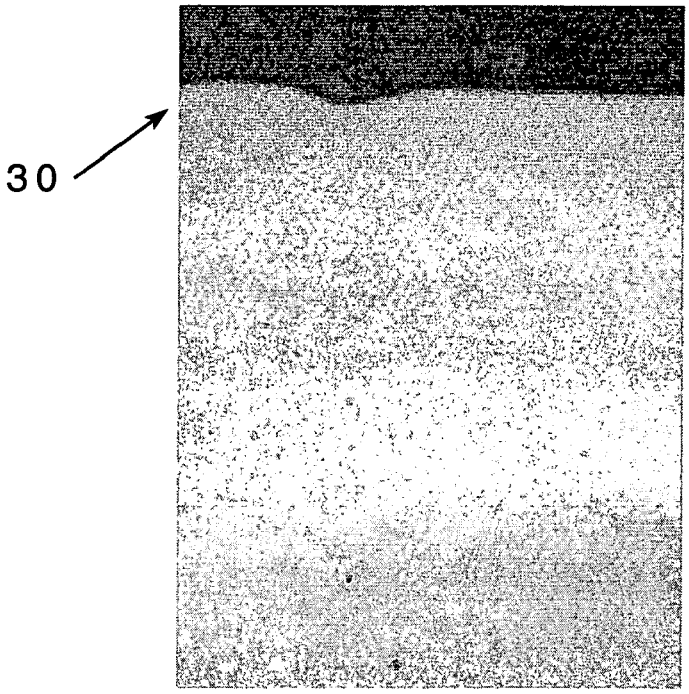
FIG. 3 is a micrograph showing a surface region of a powder metal part formed by powder forging according to one non-limiting embodiment of the present invention.

Referring now to FIG. 3, there is shown a micrograph of a portion of a surface of a P/M part, generally indicated as 30, that was formed according to a non-limiting embodiment of the present invention. In particular, the P/M part was formed by compacting a powder metal composition, sintering the green part, and densifying at least a portion of at least one surface region of the part by shot peening. Thereafter, the part was reheated in a reheat furnace and subsequently transferred to a powder forging press. During transfer of the part from the reheat furnace to the powder forging press, the part was exposed to air for about 2 to 10 seconds. The part was then forged. However, as can be seen in FIG. 3, and in contrast to FIG. 2, no finger oxides are present in or at the portion of the surface 30 of the P/M part.

Although not meant to be bound by any particular theory, the inventor believes that the densified portions of the surface of the P/M materials and parts manufactured according to the various non-limiting embodiments disclosed herein may protect the more porous, undensified portions of the compact from oxidation during the transfer period. That is, by densifying at least a portion of the surface of the part by shot peening or surface rolling prior to powder forging, oxidation of the compact during transfer from the reheat furnace (or sinter furnace) to the forging press can be reduced or eliminated.

Additionally, although not limiting herein, inventor believes that P/M parts formed according to various non-limiting embodiments disclosed herein can have improved joining characteristics. More specifically, brazing and welding conventionally processed P/M parts is often difficult because of the surface porosity of the parts. In particular, when P/M parts have surface porosity, the surface pores are prone to infiltration by the braze alloy or the weld alloy. When such infiltration occurs, little or no metallic bonding layer may be left between the two components being joined. However, the inventor believes that by forming P/M materials and parts according to the various embodiments of the invention, a very dense surface can be created which is much easier to join to the surface of other structures or parts. That is, since P/M materials and parts formed in accordance with the various non-limiting embodiments of the present invention have reduced surface porosity as compared to conventionally processed P/M materials and parts (i.e., materials and parts that are not surface densified), it is believed that the tendency of braze or weld alloys to infiltrate into the surface porosity of P/M materials and parts formed in accordance with various non-limiting embodiments of the present invention will also be reduced. Accordingly, better joining characteristics should be achieved.

Thus, according to one non-limiting embodiment, there is provided a method of forming a component comprising: (i) providing a powder metal part comprising a surface and a core region, wherein at least a portion of the surface is uniformly densified to essentially full density to a depth of at least 0.001 inches, and at least a portion of the core region has a density of at least 92 percent of the theoretical density of the powder metal part; and (2) joining at least a portion of the surface having essentially full density to a depth of at least 0.001 inches to at least a portion of at least one additional part by at least one of welding and brazing.

Another non-limiting embodiment provides a component comprising a powder metal part comprising a surface and a core region, wherein at least a portion of the surface is uniformly densified to essentially full density to a depth of at least 0.001 inches, and at least a portion of the core region has a density of at least 92 percent of the theoretical density of the powder metal part; and at least one additional part joined to at least a portion of the powder metal part by at least one of welding and brazing at least a portion of the at least one additional part to the at least a portion of the surface having essentially full density. Suitable, non-limiting methods of making powder metal parts having at least a portion of at least one surface region having essentially full density and at least a portion of a core region having at least 92 percent theoretical density are set-fort in various non-limiting embodiments discussed above.

Further, another non-limiting embodiment provides a P/M part having a densified surface that is gas-tight. As used herein the term "gas-tight" means essentially impermeable to air at 9.7 psi. Although not limiting herein, it is believed by the inventor that the P/M parts having a densified surface that is gas-tight can be formed according to the various non-limiting embodiments for forming P/M parts described above. That is, by densifying at least a portion of a surface of a P/M part after sintering, for example by peening, it is possible to uniformly densify the at least a portion of the surface to full density to a depth of at least 0.001 inches. Accordingly, by closing off the porosity in the densified portion of the surface of the P/M part, the densified portion of the surface can be made essentially impermeable to gas. Although not limiting herein, in one non-limiting embodiment, the P/M part having a densified surface that is gas-tight is a component of an exhaust system for an internal combustion engine—for example, an exhaust gas recirculation (EGR) valve, or a flange or seal used in an exhaust system. Further, although not required, the P/M parts according to this non-limiting embodiment can further have at least a portion of a core region having a density of least 92 percent of the theoretical density of the P/M part, or can have at least a portion of a core region having essentially full density, or full density.

Still another non-limiting embodiment provides a P/M part having a densified, plated surface that is essentially free of sealing materials. That is, the surfaces of conventional plated P/M parts are typically sealed with a sealing material, such as polymers and waxes, to close up the surface porosity and prevent wicking of the plating solution into the pores. However, it is believed by the inventor that the P/M parts having densified, plated surfaces that are essentially free of sealing materials can be formed according to the various non-limiting embodiments for forming P/M parts described above and subsequently plating. That is, by densifying at least a portion of a surface of a P/M part after sintering, for example by peening, it is possible to uniformly densify the at least a portion of the surface to full density to a depth of at least 0.001 inches. Accordingly, by closing off the porosity in the densified portion of the surface of the P/M part, the densified portion of the surface can be plated without the need to seal the porosity. Although not limiting herein, in one non-limiting embodiment, the plated surface is chosen from a chromium-plated surface and a zinc-plated surface. Further, although not required, the P/M parts according to this non-limiting embodiment can further have at least a portion of a core region having a density of least 92 percent of the theoretical density of the P/M part, or can have at least a portion of a core region having essentially full density, or full density.

Embodiments of the invention will now be illustrated in the following, non-limiting examples.

EXAMPLES

Example 1

A gear was formed according to one non-limiting embodiment of the invention by compacting a powder metal composition comprising about 99.25 weight percent QMP 4401 and about 0.75 weight percent EBS wax lubricant at about 40 tsi to a density of 7.0 g/cc. The gear was then sintered at a temperature of about 2080° F. for about 20 minutes. Thereafter, portions of the surface of the gear in the tooth root region and the tooth flank region were densified by shot peening. Shot peening involved impacting with SAE S70 shot (i.e., shot having a diameter ranging from about 0.016 to about 0.046 inches) for about 10 minutes at a pressure of 100 psi. After shot peening, the densified portions of the surface of the gear were uniformly densified to a density of 7.8 g/cc (which is about 99.1 percent of the theoretical density of the powder metal part) to a depth of 0.005 inches. Further, after shot peening, the part was sized at 55 tsi. After sizing, the core had a density of 7.5 g/cc (which is about 95.3 percent of the theoretical density of the powder metal part).

Figure 4:
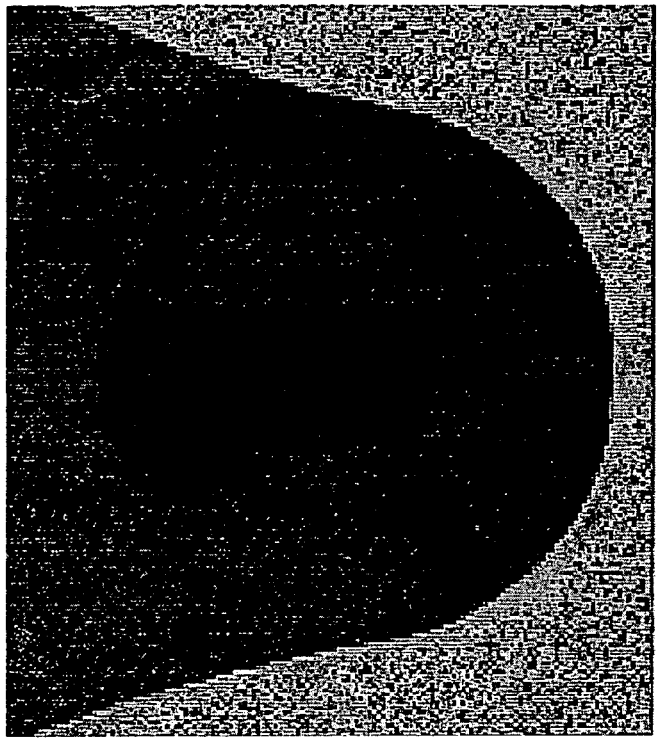
FIG. 4 is a micrograph showing the tooth root regions of a gear formed according to one non-limiting embodiment of the invention.
Figure 5:
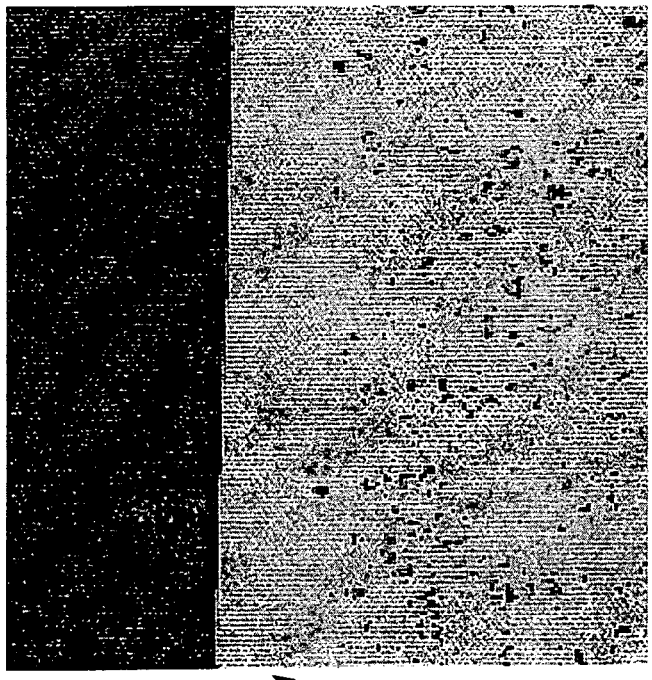
FIG. 5 is a micrograph showing a surface region of a gear formed according to one non-limiting embodiment of the invention.

Referring now to FIGS. 4 and 5, FIG. 4 is a photomicrograph of a cross-section of a portion of a tooth root region (generally indicated as 40) of the gear and FIG. 5 is a photomicrograph of a cross-section of a portion of the surface in the tooth flank region (generally indicated as 50) of the gear. As can be seen from FIG. 4, at least a portion of the surface in the tooth root region has been densified. Further, as can be seen from FIG. 5, at least a portion of the surface of the tooth flank has been densified.

Example 2

Three sets of 4600 steel-base spur gears (described below) were prepared by molding a powder compact to a green density of 6.8 g/cc and sintering at about 2080° F. for about 20 minutes in a $N_2$-10% $H_2$ atmosphere. The same powder metal composition was used to form each set of parts.

The first set of parts (SET 1) was formed according to conventional means, except that the powder forging was controlled to achieve core density of 7.6 g/cc and a surface density of 7.55 g/cc as measured using image analysis.

The second set of parts (SET 2) was formed according to one non-limiting embodiment of the present invention by post-sinter shot peening portions of the surface of the part prior to powder forging, with all other process steps performed as described above. The shot peening process comprised impacting with SAE S70 shot (i.e., shot having a diameter ranging from about 0.016 to about 0.046 inches) for about 10 minutes at a pressure of 100 psi. After shot peening, the densified portions of the surface were uniformly densified to a density of 7.8 g/cc to a depth of 0.005 inches. After forging the core regions of the parts had a density of 7.6 g/cc.

The third set of parts (SET 3) was formed in the same manner as the second set of parts. However, the density of the core regions of the parts in SET 3 was increased to 7.8 g/cc by forging at a higher pressure. Thus, after processing, both the densified surface portions of the parts and the core regions of the parts of SET 3 had a density of 7.8 g/cc.

Samples from the three sets of parts were then tested using a single tooth bending fatigue test. According to this test, an eight (8) diametral pitch spur gear having 24 teeth, with a 200 pressure angle and a 0.500 inch face width, is placed into the testing apparatus. The gear is supported at a 20.47° roll, and cyclically loaded at a 34.870 roll. That is, a single tooth of the gear at a 34.870 roll is cyclically loaded until failure or run-out at 3 million cycles occurs. During testing, the load is cycled at a frequency of 25 Hertz between the maximum load and 10% of the maximum load. Further, prior to testing, a lubricant is applied at the load and support points and other locations subject to friction. The results of these tests are given below in Table II.

TABLE II

| Set | Core Density (g/cc) | Surface Density (g/cc) | % of Test Specimens With Life >3 million cycles at Load (ksi) | | | | | | | | |
|---|---|---|---|---|---|---|---|---|---|---|---|
| | | | 130 | 140 | 150 | 160 | 170 | 180 | 190 | 200 | 210 |
| 1 | 7.6 | 7.55 | 100 | 80 | 33 | 0 | 0 | 0 | 0 | | |
| 2 | 7.6 | 7.8 | 100 | 100 | 100 | 100 | 80 | 66 | | | |
| 3 | 7.8 | 7.8 | | | | 100 | 100 | 100 | 100 | 66 | 50 |

As can be seen from the results in Table II, all of the conventionally powder forged parts (i.e., SET 1) could withstand 3 million cycles at a stress of 130 ksi. All of the parts processed according to embodiments of the present invention by shot peening prior to powder forging to a core density of 7.6 g/cc (i.e., SET 2) could withstand 3 million cycles at a stress of 160 ksi. Further, the maximum stress that all of the SET 3 parts (i.e., those processed according to embodiments of the invention to have both a surface and a core density of 7.8 g/cc) could withstand for 3 million cycles was 190 ksi.

Example 3

Two low carbon steel gears were formed by molding at 40 tsi and sintering at 2080° F. for 20 minutes in a $N_2$-10% $H_2$ atmosphere. One gear was subsequently heated to 1800° F. in a protective atmosphere and transferred to a die held at 600° F. prior to powder forging at 60 tsi. As shown in FIG. 3, finger oxides 32 were present near the surface (generally indicated as 30) of the first gear after forging.

The second gear was processed under similar conditions to the first gear; however, portions of the surface of the second gear were shot peened as described above in Example 1 after sintering and prior to reheating and forging. As shown in FIG. 4, no finger oxides were present near the surface (generally indicated as 40) of the second gear after forging.

Example 4

Thirty 316-stainless steel powder metal parts having a generally tube-shaped section were prepared using conventional pressing and sintering processes. The tube-shaped section of the parts had an inner diameter (ID) of approximately 0.160 inches and an outer diameter (OD) of approximately 0.775 inches. Each of the thirty parts was tested for gas-tightness as follows.

The ends of the tube-shape shaped section the part were sealed with rubber stoppers. One of the rubber stoppers had a central hole though which air from a compressed air source was introduced, at a pressure of 9.7 psi, into the tube-shaped section via a flexible hose. A flow meter was placed in-line between the compressed air source and the part. The leak rate of air through the tube-shaped section of the part was determined according to the air flow through the system.

After testing the gas-tightness of the each of the parts as indicated above, at least a portion of the outer surface of the tube-shaped section of each of the thirty parts was shot peened for about 20 minutes using SAE S70 shot (i.e., shot having a diameter ranging from about 0.016 to about 0.046 inches) at approximately 100 psi to densify the exterior surface. Thereafter, the gas-tightness of the shot peened parts was again tested as described above.

As indicated in Table III below, for each of the thirty parts tested, the leak rate of air through the tube-shaped section of the part, after shot peening, was 0 cubic centimeters per minute ("cc/min"). In contrast, the leak rate of air through the tube-shaped section of the thirty parts tested after sintering and prior to shot peening ranged from 147-266 cc/minute.

TABLE III

| SURFACE CONDITION | LEAK RATE (cc/min) |
|---|---|
| As-Sintered (no shot peening) | 147-266 |
| Shot Peened After Sintering | 0 |

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, the present invention is not limited to the particular embodiments disclosed, but is intended to cover modifications that are within the spirit and scope of the invention, as defined by the appended claims.

I claim:

1. A method of forming a powder metal material comprising:

molding a powder metal composition into a compact;

sintering the compact to provide a sintered compact;

peening at least a portion of a surface of the sintered compact to densify the at least a portion of the surface;

sizing the sintered compact after peening to densify at least a portion of a core region of the sintered compact and provide a sized compact;

at least one of (i) quenching and tempering the sized compact and (ii) carburizing the sized compact; and at least one of shot peening, surface rolling, and honing at least a portion of a surface of the sized compact to introduce compressive stresses into the at least a portion of the surface.

2. The method of claim 1 wherein the powder metal composition comprises iron and at least one alloying element selected from the group consisting of nickel, molybdenum, chromium, manganese, copper, and phosphorus.

3. The method of claim 1 wherein the powder metal composition is an iron-base powder metal material having a sintered carbon content ranging from 0.02 weight percent to 0.6 weight percent.

4. The method of claim 1 wherein peening the sintered compact comprises at least one of shot peening and laser peening.

5. The method of claim 1 wherein peening at least a portion of a surface of the sintered compact comprises shot peening at least a portion of the surface of the sintered compact to densify the at least a portion of the at least one surface.

6. The method of claim 5 wherein shot peening the at least a portion of the surface of the sintered compact comprises impacting the at least a portion of at least one surface with shot having a diameter ranging from 0.005 inches to 0.331 inches.

7. The method of claim 5 wherein shot peening the at least a portion of the surface of the sintered compact comprises impacting the at least a portion of at least one surface with shot having a diameter ranging from 0.014 inches to 0.046 inches.

8. The method of claim 5 wherein shot peening the at least a portion of the surface of the sintered compact comprises impacting the at least a portion of at least one surface with shot for a shot time ranging from 5 minutes to 45 minutes.

9. The method of claim 5 wherein immediately after shot peening the at least a portion of the surface of the sintered compact, the at least a portion of the surface of the sintered compact that was shot peened is uniformly densified to a density of at least 98 percent of a theoretical density of the powder metal material to a depth ranging from 0.001 inches to 0.040 inches.

10. The method of claim 5 wherein immediately after shot peening the at least a portion of the surface of the sintered compact, the at least a portion of the surface of the sintered compact that was shot peened is uniformly densified to a density of at least 98 percent of a theoretical density of the powder metal material to a depth of at least 0.002 inches.

11. The method of claim 5 wherein immediately after shot peening the at least a portion of the surface of the sintered compact, the at least a portion of the surface of the sintered compact that was shot peened is uniformly densified to a density of at least 98 percent of a theoretical density of the powder metal material to a depth of at least 0.005 inches.

12. The method of claim 5 wherein immediately after shot peening the at least a portion of the surface of the sintered compact, the at least a portion of the surface of the sintered compact that was shot peened is uniformly densified to a density of at least 98 percent of a theoretical density of the powder metal material to a depth of at least 0.010 inches.

13. The method of claim 5 wherein immediately after shot peening the at least a portion of the surface of the sintered compact, the at least a portion of the surface of the sintered compact that was shot peened is uniformly densified to full density to a depth ranging from 0.001 inches to 0.040 inches.

14. The method of claim 1 wherein after sizing, the at least a portion of the core region of the compact has a density of at least 92 percent of a theoretical density of the powder metal material.

15. The method of claim 1 further comprising pre-sintering the compact after molding and prior to sintering.

16. The method of claim 1 further comprising plating at least a portion of the surface that was densified after sizing the sintered compact.

17. A method of forming a powder metal part comprising:

molding an iron-containing powder metal composition into a green part comprising at least one tooth having a root region and a flank region;

sintering the green part to provide a sintered part;

subsequent to sintering the green part, shot peening at least a portion of a surface of the sintered part in at least one of the tooth root region and the tooth flank region to densify the at least a portion of the surface;

sizing the part after shot peening to densify at least a portion of a core region of the part and provide a sized part;

at least one of (i) quenching and tempering the sized part and (ii) carburizing the sized part; and at least one of shot peening, surface rolling, and honing at least a portion of a surface the sized part to introduce compressive stresses into the at least a portion of the surface of the part.

18. The method of claim 17 wherein the part is chosen from a gear and a sprocket.

19. The method of claim 17 wherein immediately after shot peening the at least a portion of a surface of the sintered part, the at least a portion of the surface of the sintered part that was shot peened is uniformly densified to a density of at least 98 percent of a theoretical density of the powder metal part to a depth ranging from 0.001 inches to 0.040 inches.

20. The method of claim 17 wherein immediately after shot peening the at least a portion of a surface of the sintered part, the at least a portion of the surface of the sintered part that was shot peened is uniformly densified to a density of at least 98 percent of a theoretical density of the powder metal part to a depth of at least 0.002 inches.

21. The method of claim 17 wherein immediately after shot peening the at least a portion of a surface of the sintered part, the at least a portion of the surface of the sintered part that was shot peened is uniformly densified to a density of at least 98 percent of a theoretical density of the powder metal part to a depth of at least 0.005 inches.

22. The method of claim 17 wherein immediately after shot peening the at least a portion of a surface of the sintered part, the at least a portion of the surface of the sintered part that was shot peened is uniformly densified to a density of at least 98 percent of a theoretical density of the powder metal part to a depth of at least 0.010 inches.

23. The method of claim 17 wherein immediately after shot peening the at least a portion of a surface of the sintered part, the at least a portion of the surface of the sintered part that was shot peened is uniformly densified to full density to a depth ranging from 0.001 inches to 0.040 inches.

24. The method of claim 17 wherein after sizing, the at least a portion of the core region has a density of at least 92 percent of a theoretical density of the powder metal part.

25. The method of claim 17 further comprising pre-sintering the part after molding and prior to sintering.

26. A method of forming a powder metal part comprising:

molding an iron-base powder metal composition into a part comprising at least one tooth having a root region and a flank region;

sintering the green part to provide a sintered part;

subsequent to sintering the green part, shot peening at least a portion of a surface of the sintered part in at least one of the tooth root region and the tooth flank region to densify the at least a portion of the surface;

forging the part to densify at least a portion of a core region of the part and provide a forged part;

at least one of (i) quenching and tempering the forged part and (ii) carburizing the forged part; and at least one of shot peening, surface rolling, and honing at least a portion of the surface the forged part to introduce compressive stresses into the at least a portion of the surface.

27. The method of claim 26 wherein the part is selected from the group consisting of a gear and a sprocket.

28. The method of claim 26 wherein immediately after shot peening the at least a portion of a surface of the sintered part, the at least a portion of the surface of the sintered part that was shot peened has a density of at least 98 percent of a theoretical density of the powder metal part.

29. The method of claim 26 wherein immediately after shot peening the at least a portion of a surface of the sintered part, the at least a portion of the surface of the sintered part that was shot peened is fully dense.

30. The method of claim 26 wherein immediately after shot peening the at least a portion of a surface of the sintered part, the at least a portion of the surface of the sintered part that was shot peened is uniformly densified to a density of at least 98 percent of a theoretical density of the powder metal part to a depth ranging from 0.001 inches to 0.040 inches.

31. The method of claim 26 wherein immediately after shot peening the at least a portion of a surface of the sintered part, the at least a portion of the surface of the sintered part that was shot peened is uniformly densified to a density of at least 98 percent of a theoretical density of the powder metal part to a depth of at least 0.002 inches.

32. The method of claim 26 wherein immediately after shot peening the at least a portion of a surface of the sintered part, the at least a portion of the surface of the sintered part that was shot peened is uniformly densified to a density of at least 98 percent of a theoretical density of the powder metal part to a depth of at least 0.005 inches.

33. The method of claim 26 wherein immediately after shot peening the at least a portion of a surface of the sintered part, the at least a portion of the surface of the sintered part that was shot peened is uniformly densified to a density of at least 98 percent of a theoretical density of the powder metal part to a depth of at least 0.010 inches.

34. The method of claim 26 wherein immediately after shot peening the at least a portion of a surface of the sintered part, the at least a portion of the surface of the sintered part that was shot peened is uniformly densified to full density to a depth ranging from 0.001 inches to 0.040 inches.

35. The method of claim 26 wherein after forging, the at least a portion of the surface of the part that was shot peened is essentially free of finger oxides.

36. The method of claim 26 wherein after forging, the at least a portion of the core region of the part has a density of at least 98 percent of a theoretical density of the powder metal part.

37. The method of claim 26 wherein after forging, both the surface and the core region of the iron-base powder metal part have full density.

38. The method of claim 26 further comprising pre-sintering the compact after molding and prior to sintering.

39. A method of forming a powder metal material comprising:

molding a powder metal composition into a compact;

sintering the compact;

at least one of peening and surface rolling at least a portion of a surface of the compact after sintering to densify the at least a portion of the surface;

sizing the compact after shot peening to densify at least a portion of a core region of the compact;

at least one of (i) quenching and tempering the compact after sizing and (ii) carburizing the compact after sizing; and at least one of shot peening, surface rolling, and honing at least a portion of a surface of the compact, thereby introducing compressive stresses into the at least a portion of the surface of the compact, after sizing the compact.

40. A method of forming a powder metal material comprising:

molding a powder metal composition into a compact;

sintering the compact;

at least one of peening and surface rolling at least a portion of the surface of the compact after sintering to densify the at least a portion of the surface;

forging the compact to densify at least a portion of a core region of the compact;

at least one of (i) quenching and tempering the compact after forging and (ii) carburizing the compact after forging; and at least one of shot peening, surface rolling, and honing at least a portion of a surface of the compact, thereby introducing compressive stresses into the at least a portion of the surface of the compact.

41. The method of claim 40, wherein the powder metal composition is an iron-containing powder metal composition.

42. A method of forming a powder metal part comprising:

molding a powder metal composition into a green part comprising at least one tooth having a root region and a flank region;

sintering the green part;

subsequent to sintering the green part, shot peening at least a portion of a surface of the part in at least one of the tooth region and the tooth flank region to densify the at least a portion of the surface;

forging the part to densify at least a portion of a core region of the part;

at least one of (i) quenching and tempering the part after forging and (ii) carburizing the part after forging; and at least one of shot peening, surface rolling, and honing at least a portion of a surface of the part, thereby introducing compressive stresses into the at least a portion of the surface of the part.

* * * * *

UNITED STATES PATENT AND TRADEMARK OFFICE

CERTIFICATE OF CORRECTION

PATENT NO. : 7,416,696 B2
APPLICATION NO. : 10/767014
DATED : August 26, 2008
INVENTOR(S) : Kosco et al.

It is certified that error appears in the above-identified patent and that said Letters Patent is hereby corrected as shown below:

On the title page item (75),

Delete "John C. Kosco, St. Marys, PA (US)" and substitute -- John C. Kosco, St. Marys, PA (US) and Peter G. Imbrogno, St. Marys, PA (US) --

Signed and Sealed this

Twenty-fifth Day of August, 2009

David J. Kappos

David J. Kappos
*Director of the United States Patent and Trademark Office*